United States Patent [19]

Wolf et al.

[11] Patent Number: 4,602,619

[45] Date of Patent: Jul. 29, 1986

[54] METHOD AND DEVICE FOR PRODUCING VARIABLE SPINAL TRACTION

[76] Inventors: Susan G. Wolf, 1293 Wynridge Dr., Arden Hills, Minn. 55112; Wallace W. Lossing, 4132 Livingston Rd., Central Point, Oreg. 97502

[21] Appl. No.: 657,074

[22] Filed: Oct. 2, 1984

[51] Int. Cl.[4] ..... A61H 1/02

[52] U.S. Cl. ..... 128/75; 128/69

[58] Field of Search ..... 128/69, 75, 71

[56] References Cited

U.S. PATENT DOCUMENTS

| | | | |
|---|---|---|---|
| 1,348,896 | 8/1920 | Riesland | 128/71 |
| 2,907,324 | 10/1959 | Catanzaro | 128/71 |
| 3,167,068 | 1/1965 | Carr | 128/84 R |
| 4,243,025 | 1/1981 | Jones | 128/70 |
| 4,266,537 | 5/1981 | Bonin | 128/75 |
| 4,362,151 | 12/1982 | Cottrell | 128/75 |
| 4,432,356 | 2/1984 | Sarrell | 128/75 |
| 4,489,713 | 12/1984 | Latenser | 128/71 |
| 4,531,514 | 7/1985 | McDonald | 128/75 |

*Primary Examiner*—Edgar S. Burr
*Assistant Examiner*—Tonya Eckstine

[57] ABSTRACT

A method and device are shown in which alternate amounts of tractive force are applied to portions of the spine at an angle to the axis of elongation of the spine. In particular, for treatment of the lumbar spine, the patient is placed on his back with his upper legs extending substantially vertically and his lower legs extending horizontally. A restraining harness is then placed about the patient's pelvic area and a lifting force is applied upwardly and forwardly in the direction of the patient's head and alternates between greater and lesser amounts of force, thereby providing a variable pelvic tilt to induce healing of the discs.

5 Claims, 5 Drawing Figures

10
12
14
16
18
20
22
24
26
28
30
32
34
36
38
40
42
44
46
48
50
52
54
56
58
60
62
64
66
68
70
72
74
76
78
80
82
84
86
88
90

10
12
14
18
20
22
24
28
30
32
34
36
38
42
44
54
56
58
59
60
61
62
64
66
67
68
69
70
72
73
74
75
76
78
80
82
84
88
90
92
94
96
98
100
102
104
106
108
110
112

METHOD AND DEVICE FOR PRODUCING VARIABLE SPINAL TRACTION

BACKGROUND OF THE INVENTION

This invention relates to a device and method for applying traction to the lumbar spine and also to provide traction to other portions of the spine. Previous devices have been known which produce traction on the lumbar spine including U.S. Pat. No. 4,362,151. Other devices providing spinal traction are shown in U.S. Pat. Nos. 4,067,326, 4,197,839, 3,800,787, D-269,701, 4,461,287, 799,664 and 2,623,518.

The above mentioned devices are all passive in nature, namely there is no movement during utilization of those devices. To a certain extent, active traction devices have been known but place the patient on a table and apply a tractive force along the axis of the spine in a periodic manner. Also, recently machines have been used in orthopedic settings to dynamically exercise bodily joints such as the hip, knee and ankle.

It is therefore an object of this invention to provide an improved traction device for treatment of various spinal problems and in particular, treatment of the lumbar spine.

SUMMARY OF THE INVENTION

In the instant invention, the patient is placed on a bench, whereby the patient's upper legs are extended vertically upwardly at approximately 90° to the spine and the lower legs, then bent another 90° to be roughly parallel to the supporting surface. A restraining belt is then provided which encircles the patient's waist and an attachment strap passes upwardly from the back of the belt between the patient's legs for attachment to a rope which is in turn releasably fixed to a cleat located on a pair of arms. The arms extend from a drive assembly located on the bench on which the patient's lower legs rest. The drive assembly is located between the patient's legs and has one arm extending upwardly and outwardly from a screwdrive mechanism located therein. The first arm is attached to a second arm which is hingedly attached to the bench approximately between the patient's legs. A releasable and lockable pulley and cleat combination is attached to the end of the pair of arms and has passed therethrough the rope which is attached to the harness as previously mentioned. A handle is provided at the other end of the rope to allow the patient to initially position the apparatus before actuation of the motor drive.

Initially, the patient is placed into a position of initial pelvic tilt similar to that shown in the aforementioned U.S. Pat. No. 4,362,151. This is done by adjusting the rope through the cleat with the handle and then locking it in place. At this point, the machine is turned on and the drive slowly alternates between the initial position of pelvic tilt and the second position which provides a maximum amount of pelvic tilt. The alternation between the two amounts and the directions of force applied in the two positions produces a pumping action which increases blood flow and circulation to the discs which in turn promotes healing of damaged areas. In particular, in post-surgical situations, this pumping and flexing action stretches scar tissue which in turn promotes more rapid and complete healing. By producing a negative pressure on the disc, the flow of fluid and blood to the disc is hastened. This maximum amount of pelvic tilt is such that a patient cannot be left in that position for any significant period of time and thus must alternate between that maximum and the initial amount of pelvic tilt. By producing the force superior to the body, this maximum pelvic tilt is created.

Such treatment may be used in connection with bulged discs, herniated discs, spondylolisthesis, degenerative diseases and collapsed discs; in short, any disc problem which would be benefited by increased space between the vertebral bodies. By stretching of the scar tissue, that scar tissue does not get as bulky and cause pressure on the spinal column itself. Similarly, the device may be used to help with cervical distraction by attaching a harness to the patient's head and pulling longitudinally and upwardly relative to the patient's spine by means of a pulley attached above and behind the patient's head. The rope from the pulley is then attached to the arm as previously mentioned.

Other variations of this method and device may be used to treat other portions of the spine. In particular, in one version, a passive extension assist is provided by locating a harness directly around the patient's lower back and attaching directly upwardly to the arm previously mentioned. In yet another version, the patient lays face down and a harness is attached about the patient's upper torso to the arm while at the same time an adjustable back pad is placed between the patient's lower back and arm. The arm then operates in the same path to provide yet another passive extension assist.

These and other objects and advantages of the invention will appear more fully from the following description made in conjunction with the accompanying drawings wherein like reference characters refer to the same or similar parts throughout the several views.

DESCRIPTION OF THE PREFERRED EMBODIMENTS

Figure 1:
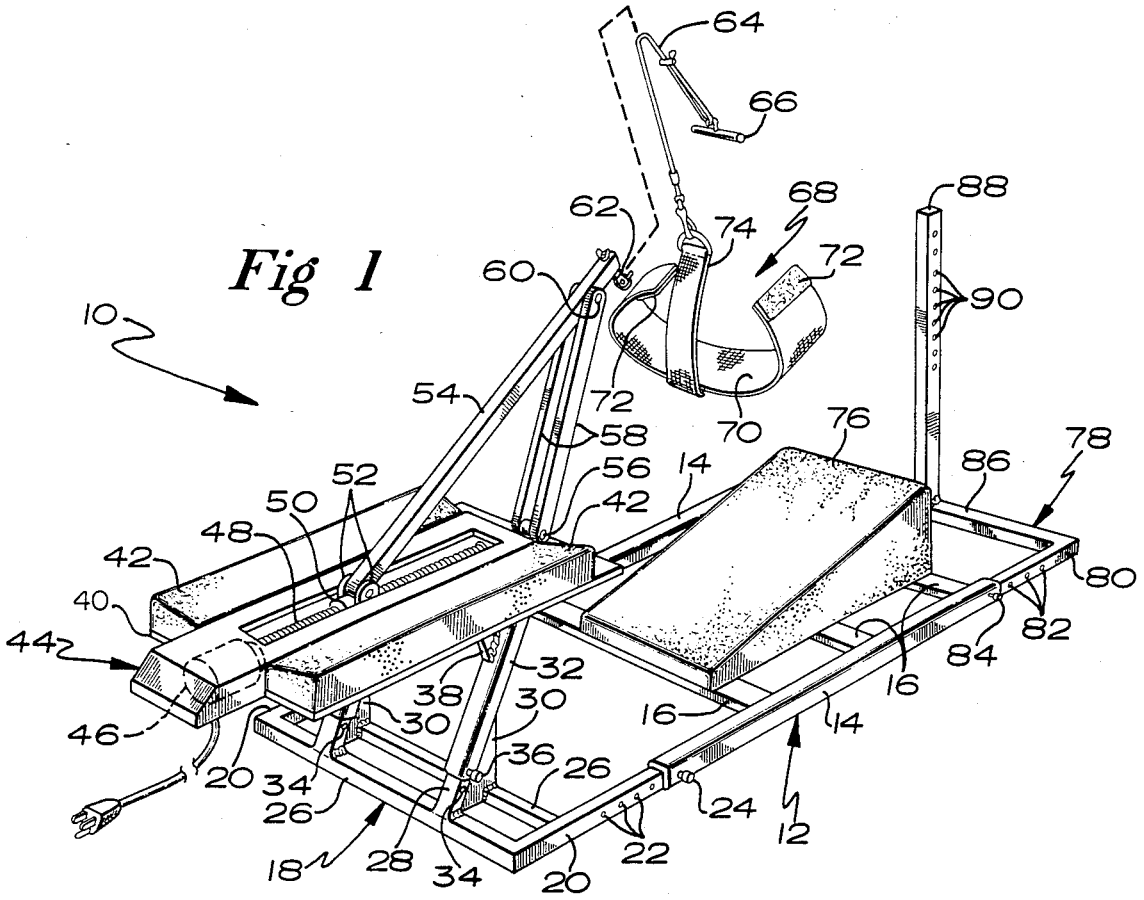
FIG. 1 is a side plan view of the invention.
Figure 2:
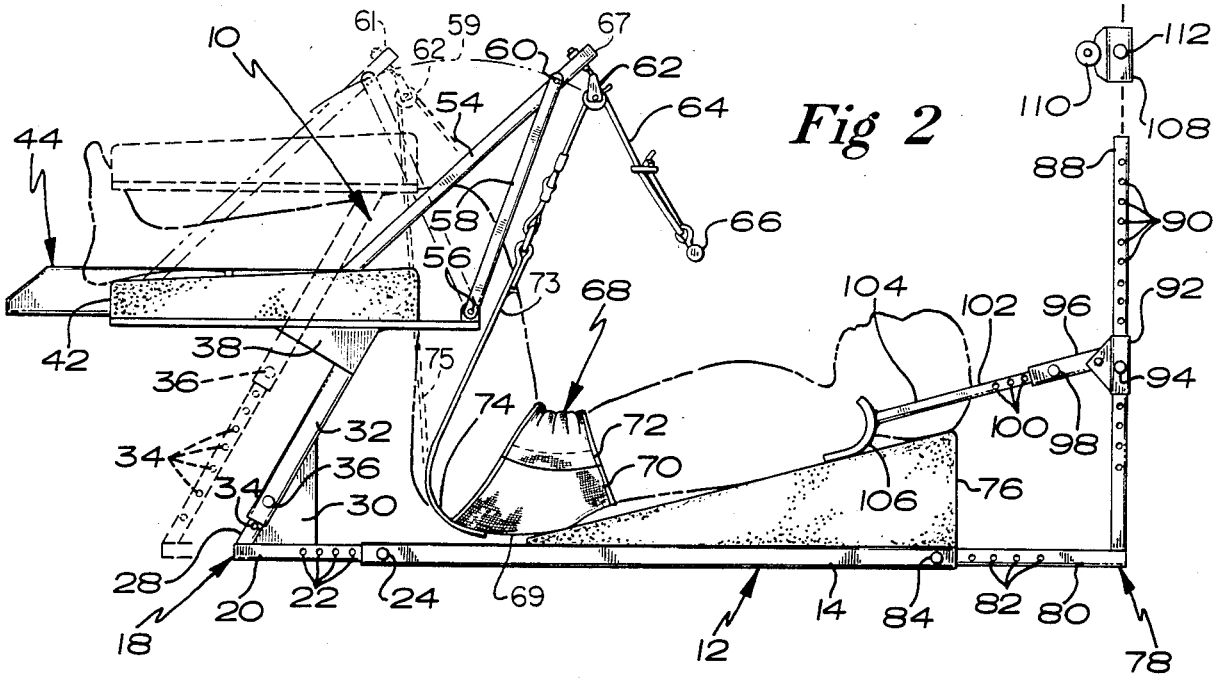
FIG. 2 is a perspective view of the invention.

The device of the instant invention generally designated 10 is shown in general in FIGS. 1 and 2 and may be used for the method of the invention. The device 10 is comprised of a frame 12 having main longitudinal rails 14 formed of square cross-section tubing. A first end frame 18 is located at one end of the main frame 12 and is provided with legs 20 which are slidably located in main longitudinal rails 14. A plurality of holes 22 are located in legs 20 to provide for alternative location of end frame 18 by means of removable pin 24. A pair of cross members 26 connects legs 20. Extension rods 28 extend upwardly and rearwardly from cross members 26 and are reinforced by gussets 30. Extension sleeve 32 is slidably located over extension rod 28 and is affixed by means of holes 34 and a removable pin 36 located therein. These two adjustments by means of pins 24 and 36 allow for adjustment of the device to suit patients of various sizes, several such adjustments being shown in phantom in FIG. 2.

A platform 40 is located at the top of extension sleeve 32 and has pads 42 on either side thereof for receiving the lower legs of the patient. A drive assembly 44 is located between pads 42 and has therein a motor 46 which turns a longitudinal screw 48. Screw 48 has located thereon a nut 50 which is in turn attached to clevis 52. A first arm 54 is pivotably attached to clevis 52. A pivot 56 located on the front edge of platform 40 pivotably attaches a pair of second arms 58 which extend upwardly whereupon they are pivotably attached to either side of first arm 54 at pivot 60.

A conventional pulley and cleat combination 62 is located at the end of first arm 54. A rope 64 passes through cleat pulley combination 62 and has attached at one end a handle 66 and at the other end a restraining harness device 68. Harness device 68 is comprised of a generally pelvic encircling belt 70 having VELCRO brand fasteners 72 at either end thereof for convenient adjustment and attachment. A lift strap 74 is attached to the middle of the back of harness device 68 and extends downwardly from belt 70 and thence between the patient's legs and upwardly for attachment to rope 64.

A wedge shaped pad 76 is located on main frame 12 and in particular on main frame cross rails 16. Pad 76 locates the patient in the proper position for treatment.

A second end frame 78 is slidably located relative to main frame 12 by means of legs 80 which are telescopically inserted in longitudinal frame rails 14. Again, a plurality of holes 82 in legs 80 allow insertion of a pin 84 to provide a variable length for a second end frame 78. A cross member 86 connects legs 80 on second end frame 78. A post 88 extends upwardly from cross member 86 and has located therein holes 90 for attachment on various devices as will be more fully described and shown hereinafter.

Figure 3:
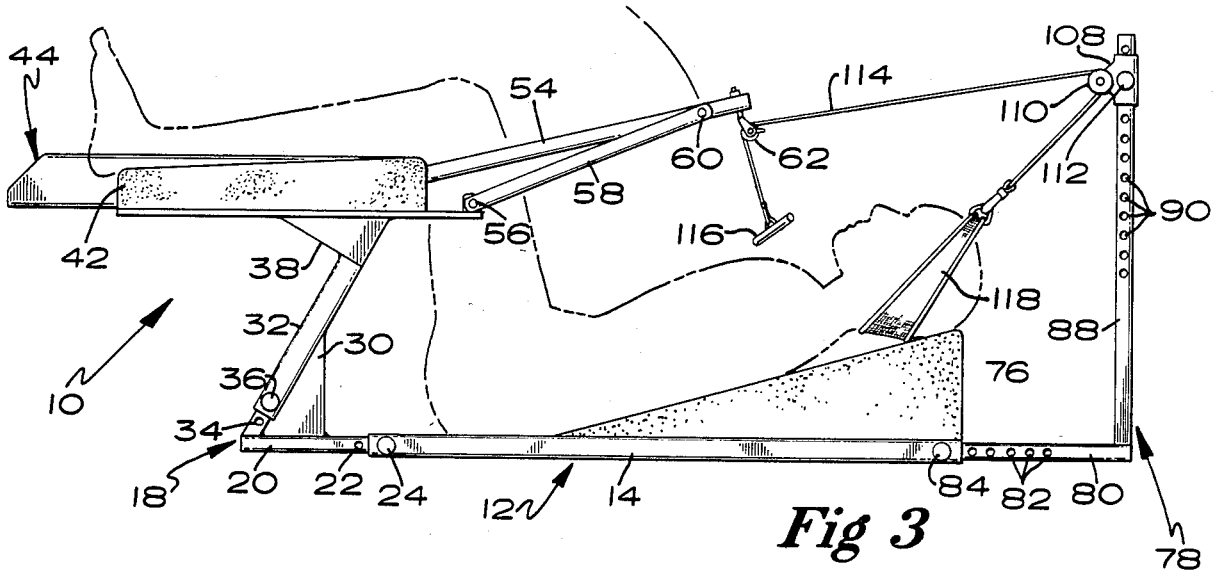
FIG. 3 is a side plan view of an alternate embodiment of the invention.

As shown in FIG. 2, a sleeve 92 may be slidably located on post 88 and fixed thereto with removable pin 94. A second sleeve 96 is attached to sleeve 92 at right angles thereto and has slidably located therein a crossbar mechanism 102, which is fixed by means of holes 100 and pin 98 to sleeve 96. Arms 104 extend from crossbar 102 and in turn have shoulder restraints 106 located at the ends thereof for engagement of a patient's shoulders, as shown in FIG. 2. A pulley sleeve 108 is also slidably located on post 88 and is attached thereto with pin 112. A pulley 110 is located on sleeve 108. Rope 114 passes through cleat pulley combination 62 over pulley 110 and terminates in a handle 116 (FIG. 3). At the other end of rope 114, a head harness 118 is utilized to provide cervical distraction.

Figure 4:
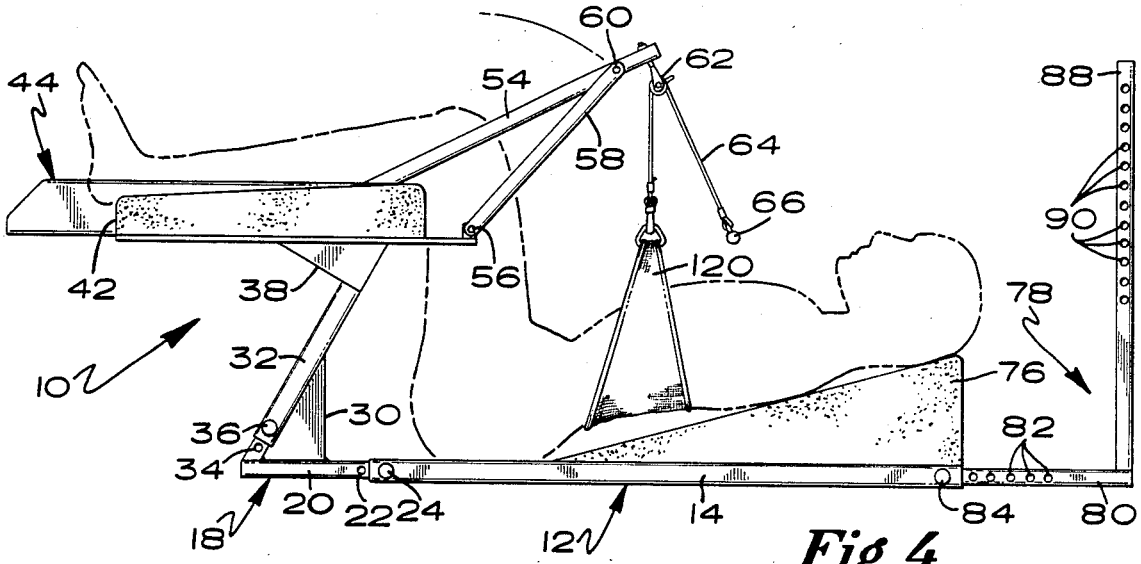
FIG. 4 is a side plan view of another alternate embodiment of the invention.

FIG. 4 shows another embodiment of the instant invention wherein a simple loop harness 120 is attached to the end of rope 64 as set forth in the FIGS. 1 and 2 embodiments.

Figure 5:
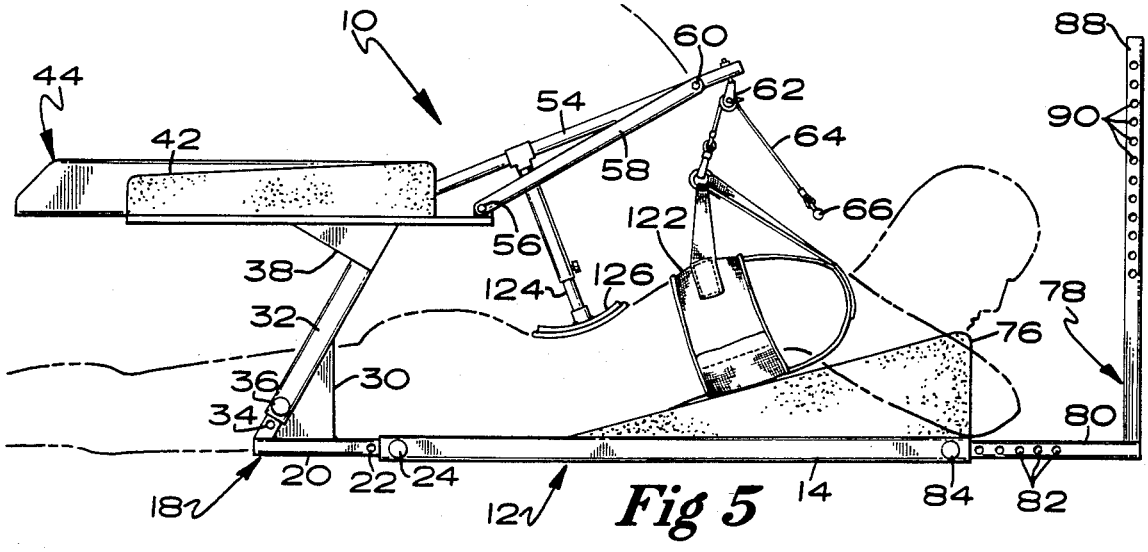
FIG. 5 is a side plan view of yet another alternate embodiment of the invention.

Similarly, in FIG. 5, a shoulder encircling harness 122 is attached to rope 64 and an adjustable shaft 124 is imposed between arm 54 and the lower back of the patient with a pad 126 being used to spread the pressure thereon.

OPERATION OF THE INVENTION

In the invention, the patient initially lies down on the apparatus such as that shown in FIG. 2. In particular, the height of the platform 40 is adjusted so that the patient assumes approximately the position shown in FIG. 2. After the restraining device harness 68 has been attached about the patient's pelvis, a lift strap 74 is passed upwardly between the patient's legs. The apparatus 10 is positioned so that arms 54 and 58 and pulley 62 are in first position 61, which is shown in phantom in FIG. 2. The rope 64 is next attached to strap 74 and follows phantom route 75 of FIG. 2 to pass through the pulley-cleat combination 62. Handle 66 is then grasped and rope 64 is pulled through pulley cleat combination 62 until the desired position 69 of minimum pelvic tilt has been obtained, that position requiring a first amount of force. The rope 64 is then locked, and the pulley 62 thereafter defines a force delivery point from which force is applied to the torso of the patient as hereafter described. This position 69 is quite similar to the positioning shown in the aforementioned U.S. Pat. No. 4,362,151, and is generally a position which can be sustained for substantial periods of time by the patient. At this point, the drive assembly 44 is activated, and the pulley 62 moves through the arc or path 59 shown in FIG. 2 between the aforementioned first position 61 having a first amount of force applied to the patient and the second position 67 shown in FIG. 2 in which a maximum amount of pelvic tilt is obtained and rope 74 follows route 73. The machine then slowly cycles between the two positions 61 and 67 shown in FIG. 2.

In the FIG. 3 embodiment, the rope 114 is fed through pulleys 110 and 62 and is locked in the same manner in the machine and then activated. Similarly, in FIG. 4 a harness 120 is placed around the lower back of the patient and adjusted and the drive assembly 44 then activated. Also, the embodiment shown in FIG. 5 is similar in that rope 64 and pad 126 and shaft 124 are adjusted as shown prior to activation of the drive assembly 64.

While the preferred embodiments of the present invention have been described, it should be understood that various changes, adaptions and modifications may be made therein without departing from the spirit of the invention and the scope of the appended claims.

What is claimed is:

1. A method of treating an injured spine of a human patient comprising the steps of:

encircling the abdominal area and pelvis of the patient with a retraining device;

placing the patient in a supine position on a support;

elevating the knees of the patient so that the patient's femora are generally upright;

lifting and suspending the restraining device and the patient by engaging a region of the device located on the underside of the patient and pulling toward a force delivery point above the supine patient and generally toward the knees of the patient so that the weight of the patient forces curvature of the patient's lumber spine; and providing a pumping action on the discs of the patient's spine so as to promote blood circulation and healing by continuously moving the force delivery point along a path above the patient's body between a first position associated with a first amount of pelvic tilt which can be withstood by the patient for extended periods, and a second position associated with a second amount of pelvic tilt greater than said first amount, said second amount of pelvic tilt being such that the patient cannot be left in said second position for any significant period of time, to continuously vary both the magnitude of the lifting force applied and the tilt of the patient's pelvis between said first and second positions.

2. The method of claim 1 and further including the step of placing the patient's lower legs in a generally horizontal orientation and at a level above the patient's abdomen.

3. A method of treating a human patient comprising the steps of:

applying a force emanating from a force delivery point to the torso of the patient at an angle relative to the axis of elongtion of the patient's spine;

moving the force delivery point along a path above the patient and between first and second positions above and along the axis of elongation; and providing a pumping action on the disk of the patient's spine so as to promote blood circulation and healing by periodically varying the amount of said force between a first amount and a second amount, said second amount being greater than said first amount, said second amount being such that the patient cannot be left in said second position for any significant period of time.

4. The method of claim 3 and further including the step of applying said force to lift the lumbar region of the patient's spine.

5. The method of claim 3 and further including the step of applying said force to the chest of the patient to provide a passive extension.

* * * * *